United States Patent [19]

Greenhaw et al.

[11] 4,451,168

[45] May 29, 1984

[54] BOTTOM LINE WORK PIECE HOLDERS

[76] Inventors: Cleo Greenhaw, 1201 Princeton; Marvin Smotone, 1213 Brentwood Dr., both of Ponca City, Okla. 74601

[21] Appl. No.: 395,915

[22] Filed: Jul. 7, 1982

[51] Int. Cl.[3] ..... B41J 13/10

[52] U.S. Cl. ..... 400/623; 400/601; 400/633.2; 400/645; 400/538; 400/542; 269/8

[58] Field of Search ..... 400/579, 601, 622, 623, 400/632, 632.1, 633, 642, 645, 633.1, 633.2, 536, 538, 542, 709.1; 269/8; 101/382 MV, 407 R, 407 BP

[56] References Cited

U.S. PATENT DOCUMENTS

| | | | |
|---|---|---|---|
| 1,219,269 | 3/1917 | Drew | 400/538 |
| 1,714,604 | 5/1929 | Kurowski | 400/632 X |
| 3,195,022 | 7/1965 | Staver | 101/382 MV |
| 3,714,894 | 2/1973 | Robinson | 401/382 MV |
| 4,239,406 | 12/1980 | Glück et al. | 400/536 |

FOREIGN PATENT DOCUMENTS

| | | | |
|---|---|---|---|
| 157657 | 1/1921 | United Kingdom | 400/632.1 |
| 932529 | 7/1963 | United Kingdom | 400/709.1 |

OTHER PUBLICATIONS

*IBM Technical Disclosure Bulletin;* "Paper Insertion Realignment Mechanism"; J. A. Craft; vol. 11, No. 4; p. 390; Sep. 1968.

*Primary Examiner*—Edgar S. Burr
*Assistant Examiner*—David A. Wiecking
*Attorney, Agent, or Firm*—Jack N. Shears

[57] ABSTRACT

A workpiece such as a paper or a card is held in proper position in a typewriter having a paper scale for typing to the bottom of the workpiece without side slippage by the inventive workpiece holders. Each of the pair of holders mounts fixably, detachably, and slidably flush with the outer surface of the paper scale and has an inner member positioned when mounted such as to be parallel to the outer surface of the paper scale and at a suitable distance out and on each side of the workpiece for free movement of the workpiece between the member and the outer surface of the paper scale.

2 Claims, 4 Drawing Figures

BOTTOM LINE WORK PIECE HOLDERS

BACKGROUND OF THE INVENTION

The invention relates to to an improvement in typewriters, more particularly typewriters having paper scales.

BRIEF DESCRIPTION OF THE PRIOR ART

The following, inter alia, is intended to be a prior art statement in accord with the guidance and requirements of 37 CFR 1.5, 1.97, and 1.98.

Though no formal pre-examination search was made on behalf of the inventor, the inventor is not aware of any holders which anticipate or render his invention obvious.

OBJECTS OF THE INVENTION

An object of the invention is to provide a means for holding a workpiece such as a paper or a card in a typewriter without misalignment until the bottom of the workpiece is reached. Workpiece holders are provided to accomplish this object.

SUMMARY OF THE INVENTION

Side slippage of a workpiece near its bottom when being typed upon in a typewriter having a paper scale is prevented by the workpiece holders of the invention. The workpiece holders comprise: a left workpiece holder and a right workpiece holder, each workpiece holder having; a body adapted for fixable, detachable, and slidable mounting flush with the outer surface of the paper scale of the typewriter, having an inner member, upon mounting, positioned parallel to the outer surface of the paper scale and at a suitable distance out from the outer surface of the paper scale for free movement of the workpiece such as a piece of paper or a card between the member and the outer surface of the paper scale.

DESCRIPTION OF THE DRAWINGS IN A PREFERRED MODE OF THE INVENTION

Figure 1:
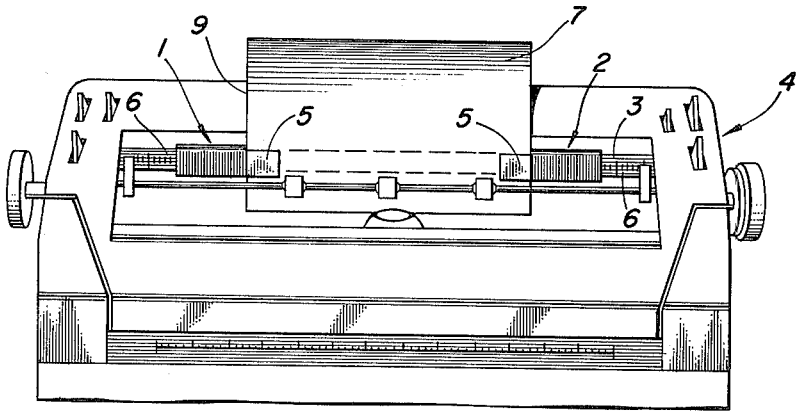
FIG. 1 is a perspective of a typewriter having embodiments of the workpiece holders of the invention, and a paper workpiece in place, as seen from the operator's position.

The following exemplification and description relating to a presently preferred mode are provided to more fully explain the invention and provide information to those skilled in the art on how to carry it out. However, it is to be understood that such is not to function as limitation on the invention as described and claimed in the entirety of this application. Referring to FIG. 1, and the other figures as appropriate, the left workpiece holder 1 and right workpiece holder 2 are shown fixably, detachably, and slidably mounted flush with the outer surface of the paper scale 3 of a typewriter 4. The inner member 5 is positioned parallel to the outer surface 6 of the paper scale 3 at a suitable distance out from the outer surface of the paper scale 3 for free movement of the paper workpiece 7 between the member 5 and the outer surface of the paper scale 6.

The paper scale holders 1 and 2 are adjusted such that inner surfaces 8 are flush with the edge 9 of the paper workpiece 7, even completely to the bottom of the page when the paper workpiece 7 is moved through the typewriter during the course of typing.

In the embodiment shown, each workpiece holder has a body 10 and an inner member 5. The body 10 has a general cross sectional shape of an inverted J best seen from the left edge of FIG. 3 and right edge of FIG. 4. The inverted J shape is adapted for fitting over the inverted L shape of the paper scale best seen in FIG. 2. In the embodiment of the presently preferred mode shown, the outer portion of the body member 11 is molded of a thermoplastic, the inner portion of the member 12 is adhered to the inner enlongated portion of the inverted J cross section of the outer portion of the body member 11, over the horizontal length of the outer body member 11 and extends integrally to form the inner member 5. A magnetic material 13 for mounting the workpiece holder fixably, detachably, and slidably flush with the outer surface of the steel paper scale of the typewriter is adhered cross sectionally inner of the long member of the J of the outer portion of the body member 11. The magnetic material 13 is of sufficient thickness to maintain the inner member 5 in a position parallel to the outer surface 6 of the paper scale 3 for free movement of the workpiece 7 between the member 5 and the outer surface 6 of the paper scale 3.

The workpiece 7 shown is a common piece of paper. Cards are also commonly typed upon as workpieces. The IBM Selectric ® or Selectric II ® typewriters that are widely employed in offices in the United States have suitable paper scales for use of the workpiece holder shown in the embodiment described. Such workpiece holders are particularly useful with such typewriters. However, other typewriters having paper scales can also be improved according to the invention.

Figure 4:
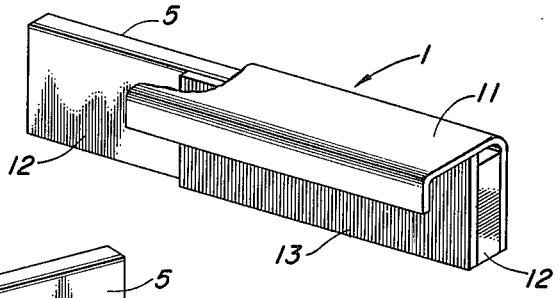
FIG. 4 shows the left workpiece holder as seen in FIG. 3, but rotated to the right 90° such as to show detail from the other side.
Figure 3:
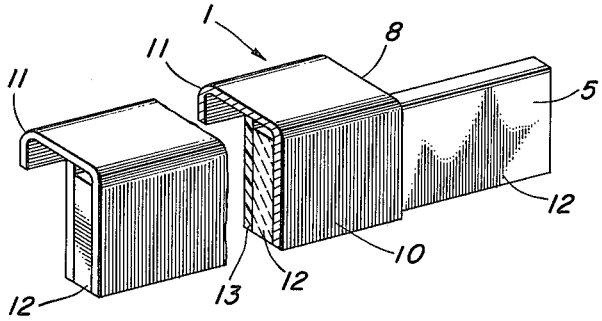
FIG. 3 shows a perspective of the left workpiece holder of the invention with a cut-a-way to show detail, as seen from the same perspective as in FIG. 2.
Figure 2:
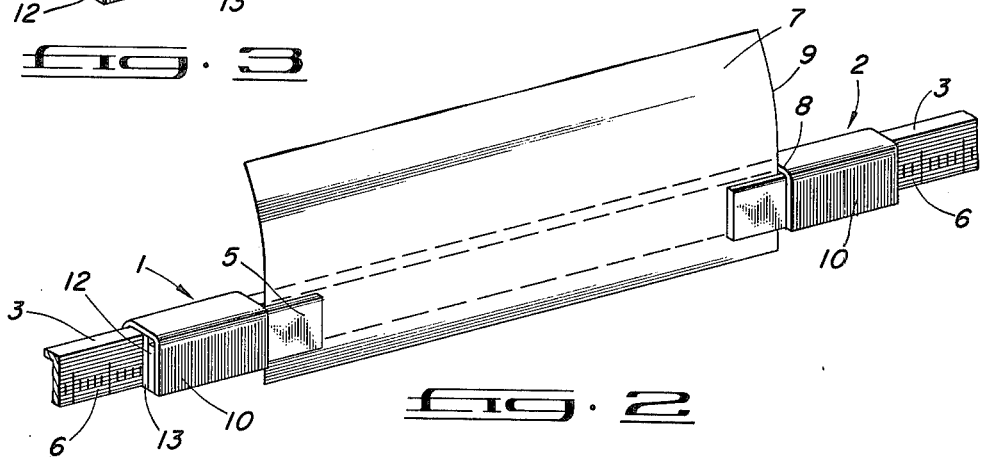
FIG. 2 shows a perspective of the workpiece holders of the invention mounted on the paper scale of a typewriter with a paper workpiece in place, as seen from the left of the operator's position.

The right workpiece holder is a mirror image of the left workpiece holder shown in FIGS. 3 and 4. In operation, the left workpiece holder and right workpiece holder are simply fixably, detachably, and slidably mounted next to the paper workpiece 7 as shown in FIGS. 1 and 2. Typing proceeds to the bottom line without sideways movement of the workpiece 7 with the workpiece holders in place. Otherwise sideways movement often occurs near the bottom of the sheet.

The workpiece holders are fabricated by conventional means of conventional materials. In the embodiment specifically disclosed, molded thermoplastics are employed.

We claim:

1. Workpiece holders for holding a workpiece in proper position in a typewriter having a paper scale, the paper scale having a flat outer surface and a flat upper surface which is generally perpendicular to the flat outer surface, the flat outer surface and the flat upper surface having a cross section corresponding to the outer surfaces of an inverted L, the workpiece being held in proper position for typing to the bottom line of the workpiece without side slippage near the bottom of the workpiece, the workpiece holders comprising:

a left workpiece holder and a right workpiece holder, each workpiece holder having;

a body adapted for fixable, detachable, and slidable mounting flush with the outer surface of the paper scale of the typewriter, the body of the workpiece holder having an inner surface corresponding to the general cross sectional shape of an inverted J adapted for fitting over the flat outer surface and the flat upper surface of the paper scale, the inner surface of the body being comprised of a magnetic material for easily fixable, slidable, and detachable mounting on the outer surface of the paper scale, and each workpiece holder also having an inner member, upon mounting, positioned parallel to the outer surface of the paper and at a distance out from the outer surface of the paper scale sufficient that free movement of the workpiece between the member and the outer surface of the paper scale is possible, characterized further in that:

the outer portion of the body member is molded of a plastic, the inner member of each workpiece is comprised of a transparent meaterial, the inner member is adhered to an inner elongated portion of the inverted J cross section over the horizontal length of the body and extending integrally to form the inner member, and cross sectionally inner of the J cross-section a magnetic material is adhered for mounting the workpiece holder fixably, detachably, and slidably flush with the outer surface of the paper scale of the typewriter, the magnetic material being of sufficient thickness to maintain the inner member in a position parallel to the outer surface of the scale and at a suitable distance out from the outer surface of the paper scale for free movement of the workpiece between the inner member and the outer surface of the paper scale.

2. The workpiece holders of claim 1 characterized such that the inner member is positioned at a suitable distance out from the outer surface of the paper scale for free movement of a common sheet of paper or card as the workpiece.

* * * * *